US011873629B2

(12) United States Patent
Willmann et al.

(10) Patent No.: US 11,873,629 B2
(45) Date of Patent: Jan. 16, 2024

(54) SANITARY INSERT UNIT

(71) Applicant: NEOPERL GMBH, Mullheim (DE)

(72) Inventors: Eugen Willmann, Mullheim (DE); Wolf-Dieter Lacher, Mullheim (DE); Holger Schurle, Mullheim (DE)

(73) Assignee: Neoperl GmbH, Müllheim (DE)

( * ) Notice: Subject to any disclaimer, the term of this patent is extended or adjusted under 35 U.S.C. 154(b) by 0 days.

(21) Appl. No.: 16/331,284

(22) PCT Filed: Jul. 12, 2017

(86) PCT No.: PCT/EP2017/000822
§ 371 (c)(1),
(2) Date: Mar. 7, 2019

(87) PCT Pub. No.: WO2018/046112
PCT Pub. Date: Mar. 15, 2018

(65) Prior Publication Data

US 2019/0234056 A1 Aug. 1, 2019

(30) Foreign Application Priority Data

Sep. 8, 2016 (DE) ..... 202016005553.5

(51) Int. Cl.
*E03C 1/08* (2006.01)
*E03C 1/04* (2006.01)
(Continued)

(52) U.S. Cl.
CPC ..... *E03C 1/086* (2013.01); *E03C 1/0405* (2013.01); *E03C 1/08* (2013.01); *E03C 1/084* (2013.01)

(58) Field of Classification Search
CPC ..... E03C 1/08; E03C 2001/0414; E03C 2001/70; E03C 1/084; E03C 1/086; E03C 1/0405
(Continued)

(56) References Cited

U.S. PATENT DOCUMENTS 2,754,097 A * 7/1956 Hjulian ..... E03C 1/084 239/428.5
2,914,084 A * 11/1959 McLean ..... F16K 1/46 137/504
(Continued)

FOREIGN PATENT DOCUMENTS

CN 1695020 11/2005
CN 201933557 8/2011
(Continued)

OTHER PUBLICATIONS

Neoperl: Perlator Honeycomb Flow Thru aerator with dual stream, Perlator® HC Flow Thru Aerator, www.neoperl.net/de/oem/products/aerators/productlines/perlatorhcflowthru.html, 1 pg. (translation enclosed), printed Jan. 2019.

*Primary Examiner* — Joseph A Greenlund
(74) *Attorney, Agent, or Firm* — Volpe Koenig

(57) ABSTRACT

A sanitary insert unit (6) is provided having an insert housing (2) which can be mounted on or in a water outlet (3) of a sanitary outlet fitting and in the housing interior of which there is provided a liquid path that channels water flowing through the housing interior. A jet splitter (9, 10) with a plurality of splitter openings (11, 13) is provided in the liquid path, and the splitter openings divide the through-flowing water into a plurality of individual jets. At least one grid or mesh structure (14, 15) follow the jet splitter (9, 10) in the liquid path, and at least one bypass duct (16) which bypasses the liquid path at least in certain portions is provided. The bypass duct (16) is formed as a nozzle for
(Continued)

generating at least one accelerated liquid jet, and for this purpose, the at least one bypass duct (16) has a tapering clear duct cross section at least in a sub-portion.

21 Claims, 5 Drawing Sheets

(51) Int. Cl.
*E03C 1/086* (2006.01)
*E03C 1/084* (2006.01)

(58) Field of Classification Search
USPC .... 239/428.5, 432, 461, 463, 466, 494, 495, 239/496, 500, 504, 587.1–587.5, 239/589–590.5
See application file for complete search history.

(56) References Cited

U.S. PATENT DOCUMENTS 3,130,911 A * 4/1964 Billeter ..... B05B 1/323 239/109
3,334,818 A * 8/1967 Moen ..... B05B 7/0425 239/431
3,847,178 A * 11/1974 Keppel ..... F16K 1/465 137/515.7
4,582,253 A * 4/1986 Gerdes ..... E03C 1/084 239/447
5,348,231 A * 9/1994 Arnold ..... E03C 1/084 239/447
5,634,491 A * 6/1997 Benedict ..... E03C 1/08 239/533.13
6,571,831 B1 * 6/2003 Hart ..... G05D 7/012 138/45
7,431,224 B2 * 10/2008 Laker ..... B05B 1/1609 239/533.1
7,581,685 B2 * 9/2009 Belisle ..... B05B 1/1609 239/443
7,731,107 B2 6/2010 Grether
7,748,406 B2 * 7/2010 Pilatowicz ..... E03C 1/08 239/443
D622,356 S * 8/2010 Grether ..... D23/249
8,402,995 B2 * 3/2013 Zoller ..... G05D 7/012 137/454.2
9,562,348 B2 * 2/2017 Sochtig ..... E03C 1/086
9,657,467 B2 * 5/2017 Stein ..... B05B 1/1609
9,663,928 B2 * 5/2017 Stein ..... G05D 7/014
10,060,540 B2 * 8/2018 Cutler ..... F16K 11/044
2001/0042869 A1 11/2001 Fujimura
2003/0080213 A1 * 5/2003 Clauss ..... A62C 31/02 239/428.5
2004/0124267 A1 * 7/2004 Ouyoung ..... E03C 1/08 239/394
2005/0247805 A1 * 11/2005 Grether ..... B05B 15/40 239/548
2006/0180681 A1 * 8/2006 Lau ..... E03C 1/08 239/383
2007/0257136 A1 * 11/2007 Kogelbauer ..... B05B 7/0425 239/533.12
2008/0251604 A1 * 10/2008 Schmid ..... E03C 1/084 239/113
2009/0020628 A1 * 1/2009 Belisle ..... B05B 1/1609 239/428.5
2009/0224067 A1 * 9/2009 Grether ..... E03C 1/084 239/106
2010/0147397 A1 * 6/2010 Zoller ..... G05D 7/012 137/115.13
2011/0017322 A1 1/2011 Zoller
2011/0240767 A1 * 10/2011 Kitaura ..... E03C 1/084 239/428.5
2012/0311777 A1 * 12/2012 Le ..... A61H 33/027 4/541.6
2013/0008980 A1 * 1/2013 Grether ..... E03C 1/08 239/428.5
2013/0068860 A1 * 3/2013 Tempel ..... B05B 1/3073 239/428.5
2013/0082121 A1 * 4/2013 Stein ..... E03C 1/08 239/428.5
2014/0217202 A1 * 8/2014 Stein ..... E03C 1/08 239/392
2017/0298600 A1 * 10/2017 Rosko ..... E03C 1/084
2017/0335980 A1 * 11/2017 Cutler ..... B05B 1/1618
2018/0209571 A1 * 7/2018 Stein ..... E03C 1/084
2019/0234056 A1 * 8/2019 Willmann ..... E03C 1/084

FOREIGN PATENT DOCUMENTS

CN 103443367 12/2013
CN 103968109 8/2014
CN 204715472 10/2015
CN 105839716 8/2016
CN 206529848 9/2017
DE 2141552 2/1973
DE 3903800 8/1990
DE 10246334 4/2004
DE 102004044158 1/2006
DE 202006018577 1/2008
DE 102006057787 5/2008
DE 102007009717 9/2008
DE 202010007835 11/2011
JP 2000080687 3/2000
WO 2018046112 3/2018

* cited by examiner

SANITARY INSERT UNIT

BACKGROUND

The invention relates to a sanitary insert unit having an insert housing which is mountable on or in a water outlet of a sanitary outlet fitting and in the housing interior of which a liquid path is provided which carries water flowing through the housing interior, wherein, in the liquid path, a jet splitter having a plurality of splitter openings is provided, which divide the water flowing through into a plurality of individual jets, and having at least one lattice or mesh structure following the jet splitter in the liquid path, and wherein at least one bypass duct that at least partially bypasses the liquid path is provided.

A sanitary insert unit of the type mentioned at the beginning, having an insert housing which is mountable at the water outlet of a sanitary outlet fitting with the aid of an outlet mouthpiece, is already known (cf. online publication at www.neoperl.net/de/oem/products/aerators/productlines/perlatorhcflowthru.html and U.S. Design Pat. D622,356). Provided in the housing interior of the insert housing is a liquid path which carries water flowing through the housing interior. In order to mix the water carried by the liquid path with ambient air and in order to form a homogeneous, non-spraying water jet, a jet splitter having a plurality of splitter openings is provided in the liquid path, said splitter openings dividing the water flowing through into a plurality of individual jets, wherein at least one lattice or mesh structure is connected downstream of the jet splitter in the liquid path, said lattice or mesh structure combining the aerated individual jets before a homogeneous overall jet of aerated water emerges from the insert housing. In order for it to also be possible if necessary for filtered or carbonated water to emerge via an outlet, separate therefrom, of the sanitary insert unit, a central bypass duct is provided in the insert housing, said bypass duct at least partially bypassing the liquid path, with the outflow-side duct opening of said bypass duct protruding beyond the outlet end face of the insert housing.

SUMMARY

In various arid countries, there is only very low water pressure in the water supply network, and in other countries, it is mandatory for a low volume flow to be maintained per unit time, such that it is scarcely possible to effectively clean for example a safety razor or similar article with this low amount of water per unit time. Therefore, the object is to create a sanitary insert unit of the type mentioned at the beginning, which, even with low amounts of water emerging per unit time, nevertheless gives the user the possibility to clean articles with a powerful cleaning jet if necessary.

The invention achieves this object, in the case of the sanitary insert unit of the type mentioned at the beginning, in particular in that the bypass duct is in the form of a nozzle for creating at least one accelerated liquid jet, and in that the bypass duct to this end has a narrowing clear duct cross section at least in one section.

The insert unit according to the invention has an insert housing which is mountable on or in a water outlet of a sanitary outlet fitting. To this end, an external thread can be provided on the housing outer circumference of the insert housing, said external thread being able to be screwed together with an internal thread in the water outlet. However, it is also possible for the insert housing to be insertable into a sleeve-like outlet mouthpiece which can be screwed, with the aid of a thread, together with a counterpart thread on the water outlet. Provided in the housing interior of the insert housing is a liquid path, which can carry a water flow therethrough. Provided in this liquid path is a jet splitter which has a plurality of splitter openings that divide the water flowing through into a plurality of individual jets. At least one lattice or mesh structure is connected downstream of the jet splitter in the liquid path, said lattice or mesh structure acting as a flow straightener or as a homogenizing device and being intended to shape the individual jets coming from the jet splitter, optionally after being enriched and mixed with ambient air, into a soft overall jet emerging from the insert housing. The insert unit according to the invention has at least one bypass duct that at least partially bypasses the liquid path and serves to create at least one accelerated liquid or cleaning jet. Thus, in the overall jet flowing out of the sanitary insert unit a liquid or cleaning jet that is accelerated compared with the overall jet is generated with the aid of the at least one bypass duct in the form of a nozzle, said liquid or cleaning jet being distinguished by an increased cleaning force compared with the rest of the overall jet.

In order to noticeably reduce the water consumption and in order to be able to set the flow rate to a low maximum value, it is advantageous when a flow rate regulator is provided in the insert housing on the inflow side upstream of the jet splitter, said flow rate regulator regulating the water flowing through to a pressure-independent maximum flow rate.

In a functionally reliable embodiment of the invention, which can be produced cost-effectively and accommodated in the insert housing in a space-saving manner, the flow rate regulator has at least one elastic annular throttle body which engages around a regulator core and delimits a control gap between itself and regulating profiling provided on the outer circumferential wall of the regulator core or an inner circumferential wall surrounding the throttle body, said control gap changing under the pressure of the water flowing through such that the flow rate of the flow rate regulator does not exceed a pressure-independent maximum value.

In order that an effective liquid or cleaning jet can be formed in the bypass duct even by the comparatively low flow rate, it is advantageous when the bypass duct narrows in the direction of its outflow-side duct opening at least in at least one conical section.

In a structurally particularly simple embodiment of the invention that is producible with little outlay, the bypass duct has an inflow-side duct opening which is arranged in the liquid path beneath at least one of the splitter openings and in particular beneath at least two of the splitter openings. In this embodiment, a liquid or cleaning jet is created from at least one individual jet formed in the jet splitter. In this case, in a particularly advantageous embodiment, which is distinguished by a particularly effective cleaning jet, the smallest clear duct cross section of the at least one bypass duct comprises a clear cross-sectional area which is smaller than the cross-sectional area of the splitter opening that opens into the inflow-side duct opening or than the sum of the clear cross-sectional areas of the splitter openings that open into the inflow-side duct opening.

In order for it to be possible to shape the liquid or cleaning jet regardless of the jet splitter and optionally the upstream flow rate regulator, it may be advantageous when the bypass duct passes through the jet splitter and optionally also through the flow rate regulator.

It is possible for the jet splitter to be in the form of a perforated plate. By contrast, in another embodiment, which affords advantages in particular at low water pressures, the jet splitter is in the form of a diffuser which has an impact surface that deflects the inflowing water in the direction of splitter openings which are provided in an outer circumferential wall of the diffuser. In this embodiment, the water flowing out is initially braked at the impact surface of the diffuser formed at least in this subregion for example in a cuplike manner and is deflected before the water that is deflected in particular outwardly in this way is divided into individual jets in the splitter openings, said splitter openings being provided in the outer circumferential wall of the diffuser.

In order to create a negative pressure in the region of the jet splitter, by which ambient air can be drawn into the housing interior of the insert housing, in a preferred embodiment of the invention, the outer circumferential wall of the diffuser is surrounded by a diffuser ring, and, between the outer circumferential wall and the diffuser ring, an annular gap is provided which at least partially narrows in the flow-through direction of the water.

In order that only a limited water volume per unit time is shaped into a soft, non-spraying water jet in the insert unit according to the invention, it is expedient when the flow rate regulator is arranged on the inflow side upstream of the jet splitter and optionally also upstream of the/an inflow-side duct opening of the bypass duct. If the flow rate regulator is in this case also arranged upstream of the inflow-side duct opening of the bypass duct, a fixed maximum value of the flow rate can be maintained even taking the hard liquid or cleaning jet generated in the bypass duct into consideration.

Disruptions caused by dirt particles entrained in the water flow can be avoided and fault-free functioning of the insert unit and the constituent parts thereof can be achieved when the insert unit has a filter screen, said filter screen being arranged in the inflow direction upstream of the jet splitter and optionally upstream of the flow rate regulator connected in between.

When the bypass duct passes through the jet splitter and optionally also through an upstream flow rate regulator, it may be expedient when the/an inflow-side duct opening of the bypass duct is arranged in the inflow direction immediately beneath the filter screen. This also avoids a situation in which the dirt particles entrained in the water can clog up or even just constrict the nozzle opening provided in the bypass duct.

In a preferred embodiment of the invention, the filter screen widens preferably conically in the flow-through direction. This embodiment has the advantage that the insert unit, formed for example from the inflow-side dome screen or filter screen, a downstream-side jet regulator and if necessary a flow rate regulator or flow limiter connected in between, can be formed, at least on its outer circumferential periphery, with a comparatively small longitudinal extent, even though the screen surface of the dome screen or filter screen protruding into the inflow-side clear cross section of the outlet fitting has been formed in a comparatively large manner.

In another embodiment according to the invention, the filter screen is funnel-shaped, and the funnel shape of the filter screen narrows in the direction of an inflow-side duct opening of the at least one bypass duct.

In order that an external soft and non-spraying overall jet can be formed in the insert unit according to the invention, said overall jet surrounding a hard cleaning jet that is arranged in the center thereof and is easily detectable there, it is advantageous when the bypass duct is arranged approximately coaxially with the longitudinal center axis of the insert housing.

In one development of the invention, the bypass duct narrows in the direction of a preferably central nozzle opening in order to create a water jet, said nozzle opening having the smallest clear cross section of the bypass duct.

In order if necessary also to be able to provide a larger jet cross section in the cleaning jet for cleaning purposes, it may be advantageous when the bypass duct narrows in the direction of an annular gap in order to create an annular jet.

To this end, in a structurally particularly simple embodiment of the invention, the bypass duct has a cylindrical clear cross section, and an insert part that narrows at least partially in the flow-through direction has been inserted into the bypass duct, said insert part bounding, between its outer circumference and the inner circumferential wall of the bypass duct, the annular gap.

In order to be able to design the cleaning jet regardless of the flow rate of an optionally upstream flow rate regulator, it is expedient when at least one unregulated flow-through duct that leads to an inflow-side duct opening of the bypass duct passes through the regulator core of the flow rate regulator.

It may be advantageous when the annular gap or the nozzle opening forms an outflow-side duct opening of the bypass duct. In this embodiment, an article to be cleaned can be arranged a short distance beneath the duct opening of the bypass duct such that said cleaning jet strikes the article to be cleaned in a virtually unimpeded manner and can develop its cleaning force fully there.

In this case, in a preferred embodiment of the invention, the outflow-side duct opening of the bypass duct is arranged approximately in an outflow-side end plane or at least as far as an outflow-side end plane of the insert housing.

In order that the water flowing through the liquid path in the insert housing can be shaped into a soft and non-spraying overall jet again on the outlet side, it is expedient when a lattice structure having approximately honeycomb-shaped lattice openings is provided on the/an outflow-side end plane of the insert housing. In this case, the webs that form the lattice structure can have a longitudinal extent oriented in the flow-through direction that is equal to or greater than the maximum clear opening cross section of the lattice openings. As a result of the honeycomb-shaped design of the lattice openings, the water flowing through is opposed only a little and nevertheless a non-spraying overall jet can be formed particularly well.

In order to be able to form a non-spraying overall jet from the water carried in the liquid path and in order to optionally also favor the mixing of this water flow with ambient air, it is advantageous when at least one preferably annular insert part has been inserted into the insert housing, said insert part having a lattice or mesh structure interposed in the liquid path.

In this case, in a preferred embodiment of the invention, the insert parts are arranged in the liquid path beneath the jet splitters.

In order to create a pearly-soft overall jet, it is advantageous when, in order to mix the water flowing through the liquid path with ambient air, the sanitary insert unit has at least one aeration duct which opens into the liquid path preferably beneath the jet splitter.

To this end, in a preferred embodiment of the invention, the at least one aeration duct is in the form of a housing opening provided in a housing circumferential wall of the insert housing.

BRIEF DESCRIPTION OF THE DRAWINGS

Developments of the invention can be gathered from the drawing in conjunction with the description of the figures and the claims. The invention is described in more detail in the following text with reference to preferred exemplary embodiments.

In the drawings.

DETAILED DESCRIPTION

Figure 2:
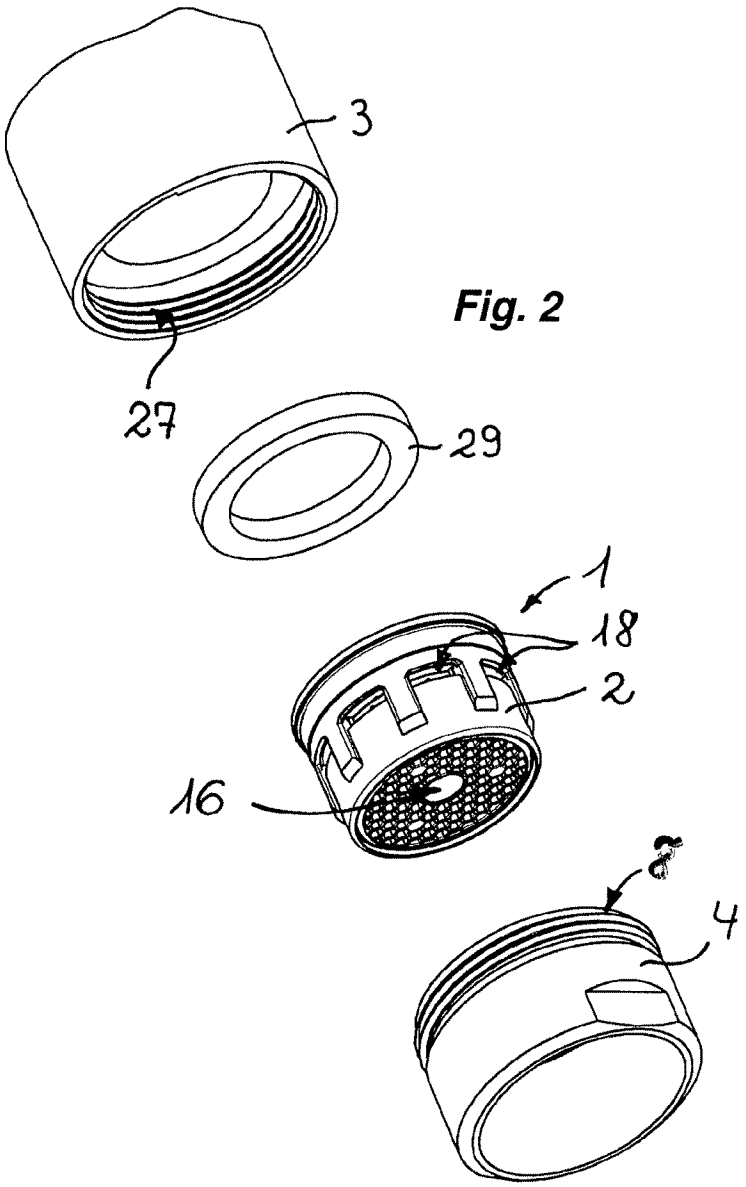
FIG. 2 shows the insert unit from FIG. 1 in an exploded perspective illustration looking toward the outlet end face of this insert unit.
Figure 1:
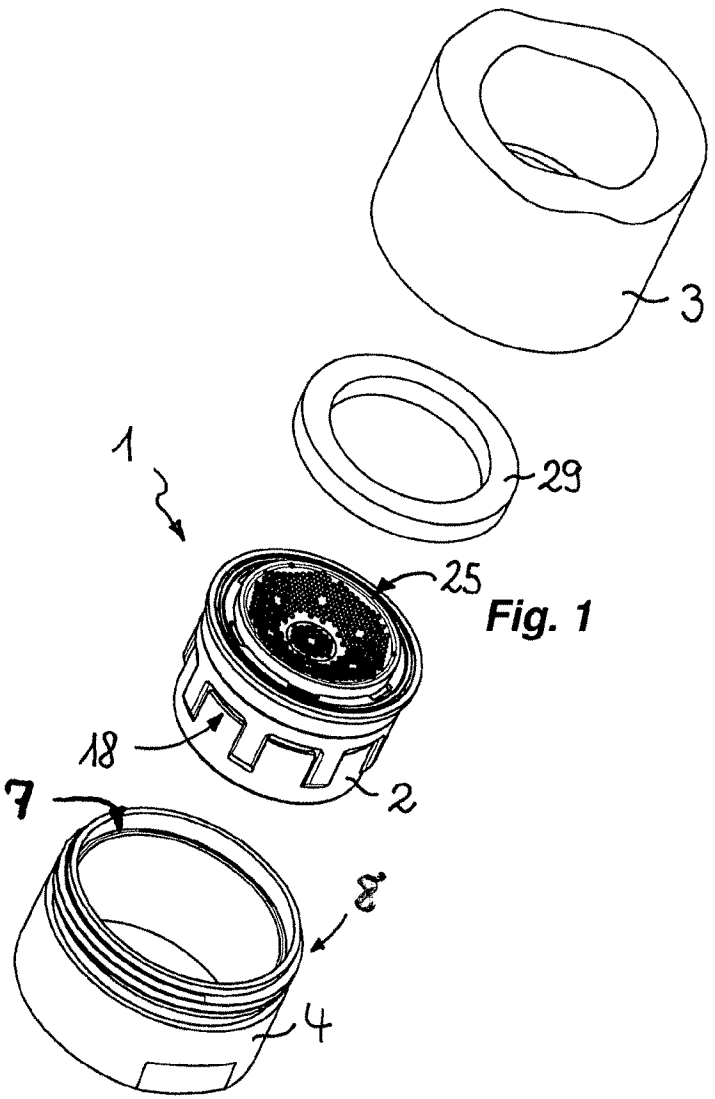
FIG. 1 shows a sanitary insert unit which is mountable by means of a sleeve-like outlet mouthpiece on the water outlet of a sanitary outlet fitting, in an exploded perspective illustration of these constituent parts, wherein the insert unit shapes the water flowing through into a soft, non-spraying overall jet which surrounds a hard cleaning jet in its jet center.
Figure 5:
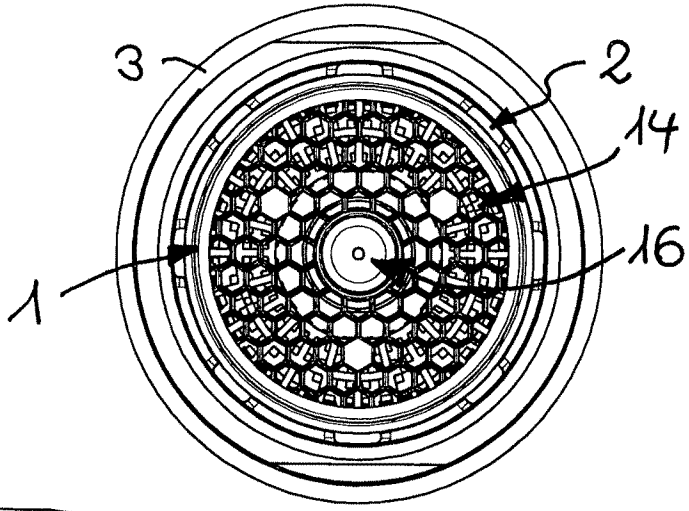
FIG. 5 shows the insert unit, mounted on the water outlet of the outlet fitting by the outlet mouthpiece, from FIGS. 1 to 4 in a plan view of the outlet end face.
Figure 4:
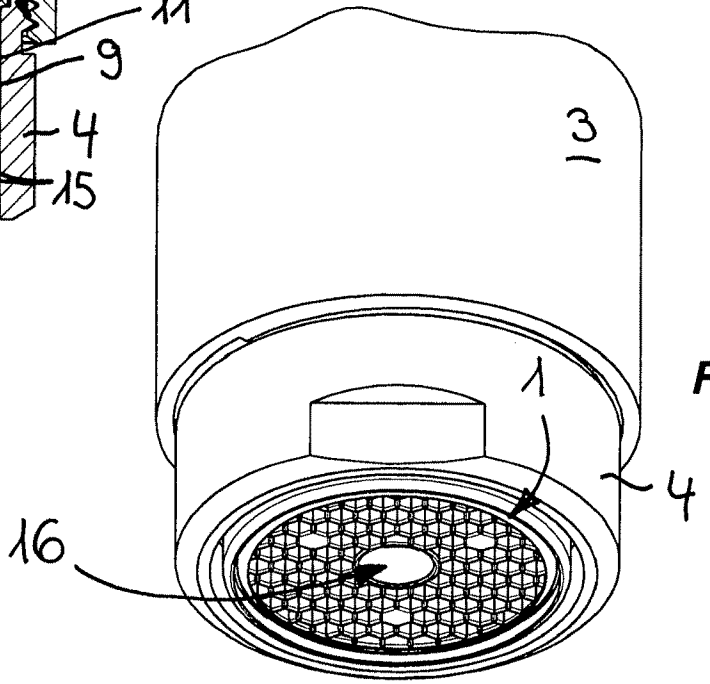
FIG. 4 shows the insert unit, mounted on the water outlet of the outlet fitting by the outlet mouthpiece, from FIGS. 1 to 3 in a perspective side view.
Figure 3:
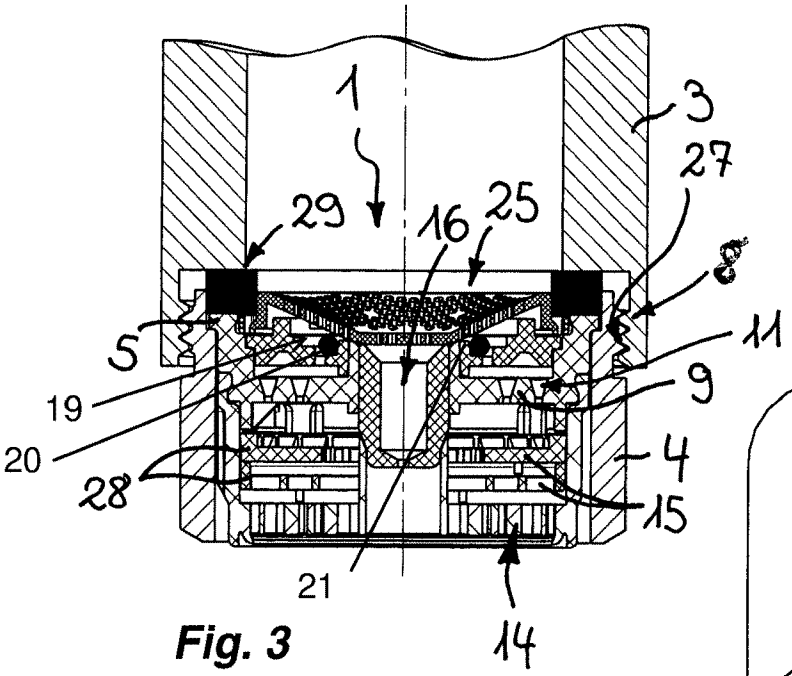
FIG. 3 shows the insert unit, mounted on the water outlet of the outlet fitting by the outlet mouthpiece, from FIGS. 1 and 2 in longitudinal section.
Figure 7:
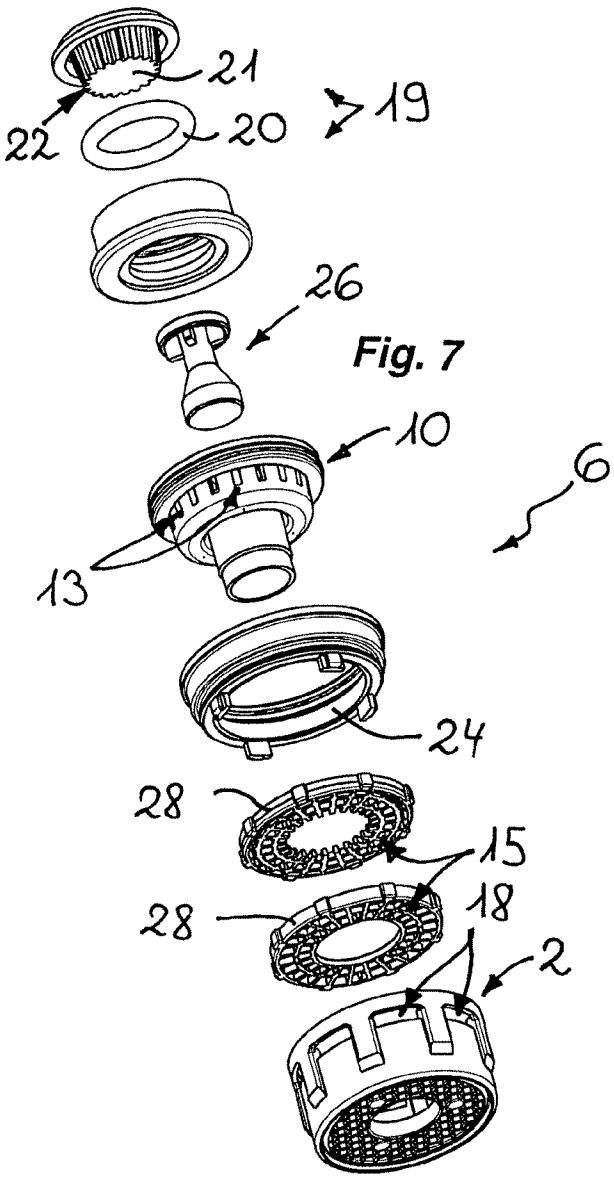
FIG. 7 shows the insert unit from FIG. 6 in a perspective side view looking toward the outlet end face of this insert unit.
Figure 6:
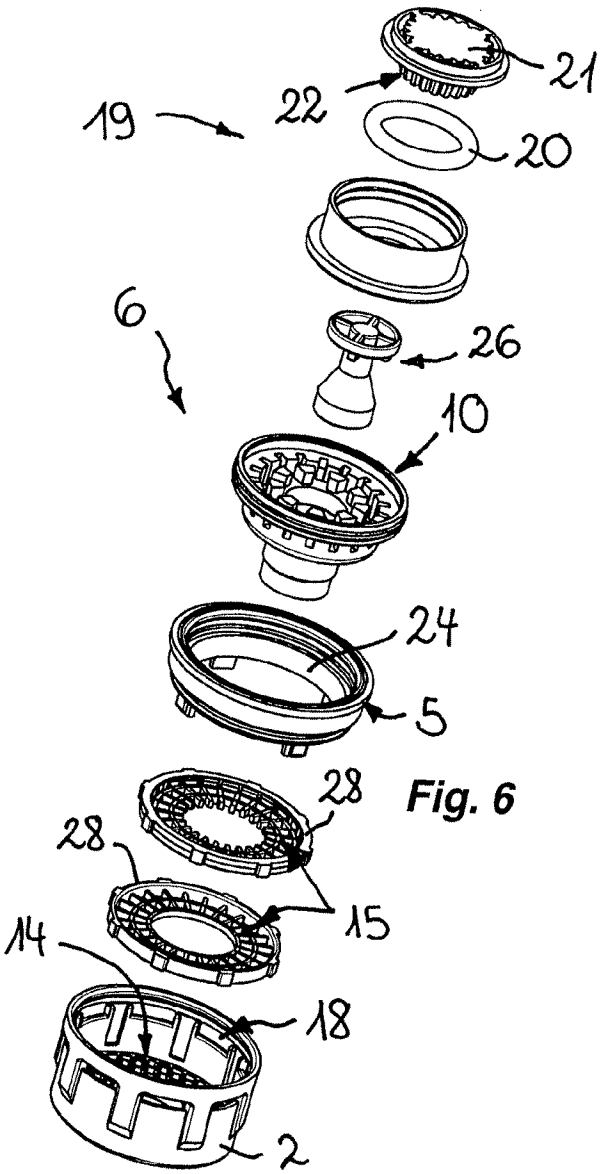
FIG. 6 shows a sanitary insert unit, shown in an exploded illustration of its individual parts, which likewise forms a soft, non-spraying overall jet and a central cleaning jet surrounded thereby, wherein the cleaning jet is embodied here as an annular jet.
Figure 10:
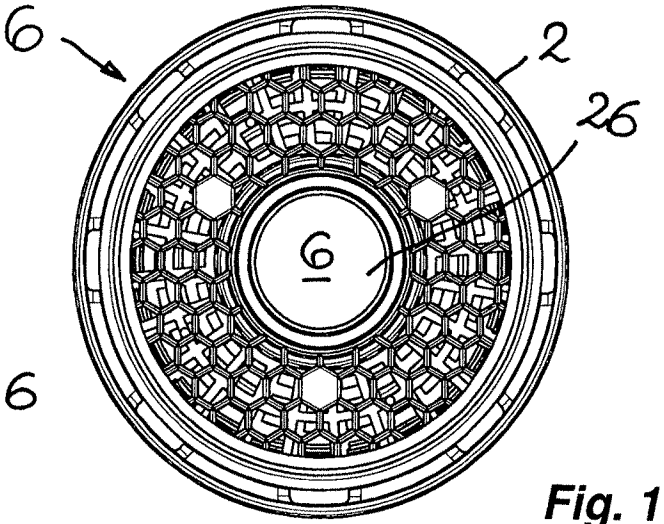
FIG. 10 shows the insert unit from FIGS. 6 to 9 in a plan view of its outlet end face.
Figure 11:
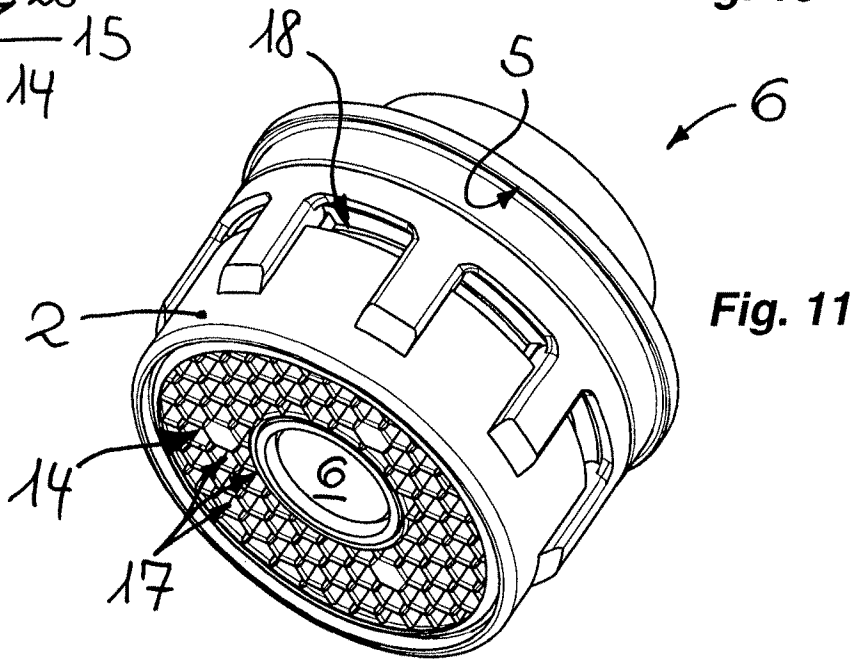
FIG. 11 shows the insert unit from FIGS. 6 to 10 in a perspective side view.
Figure 8:
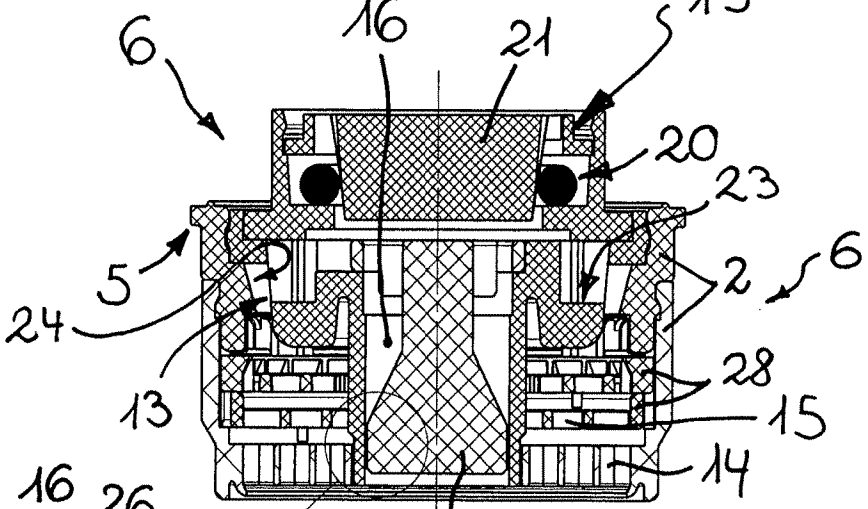
FIG. 8 shows the insert unit from FIGS. 6 and 7 in longitudinal section.
Figure 9:
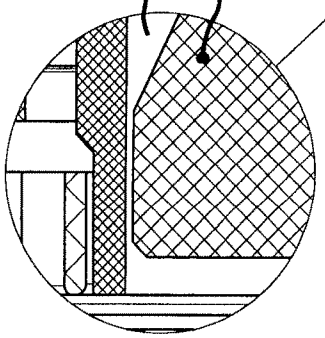
FIG. 9 shows a detail of the insert unit from FIGS. 6 to 8 in longitudinal section in the region circled in FIG. 8.

FIGS. 1 to 14 illustrate different embodiments 1, 6 and 12 of a sanitary insert unit. The insert units 1, 6, 12 have an insert housing 2 which is mountable on a water outlet 3 of a sanitary outlet fitting that is not otherwise illustrated further here. The insert housing 2 of the insert units 1, 6, 12 is to this end insertable from the inflow side into a sleeve-like outlet mouthpiece 4, until an annular flange 5 provided on the outer circumference of the insert housing 2 bears on an annular shoulder, serving as a support 7, on the inner circumference of the outlet mouthpiece 4. The outlet mouthpiece 4 is able to be screwed, by way of a thread 8, together with a counterpart thread 27 on the water outlet 3, wherein the separation zone can be sealed off by a sealing ring 29.

Provided in the housing interior of the insert housing 2 of the insert units 1, 6, 12 is a liquid path, which can carry water flowing through. Provided in this liquid path is a jet splitter 9 or 10, which has a plurality of splitter openings 11 or 13, respectively, which divide the water flowing through into a plurality of individual jets. Connected downstream of the jet splitter 9, 10 of the insert units 1, 6, 12 in the liquid path is at least one lattice or mesh structure 14, 15, which acts as a flow straightener or as a homogenizing device and is intended to shape the individual jets coming from the jet splitter, optionally after they have been enriched and mixed with ambient air, into a soft, non-spraying overall jet emerging from the insert housing 2. The insert units 1, 6, 12 have at least one bypass duct 16 that at least partially bypasses the liquid path and is intended to create at least one accelerated liquid or cleaning jet. To this end, this bypass duct 16 has a narrowing clear duct cross section at least in one section. Thus, in the overall jet flowing out of the insert units 1, 6, 12, a cleaning jet that is accelerated compared with the overall jet is generated with the aid of the at least one bypass duct 16 in the form of a nozzle, said cleaning jet being distinguished by a high cleaning force.

In order to be able to create a hard central cleaning jet in the overall jet flowing out of the liquid path of the insert units 1, 6, 12, said central cleaning jet being easy to locate clue to its defined position in the jet cross section, the bypass duct 16 is arranged approximately coaxially with the longitudinal center axis of the insert housing 2 of the insert units 1, 6, 12. The lattice structure 14 which is provided on the outflow-side end face of the insert housing 2 and in this case is integrally formed on the insert housing 2 has honeycomb-shaped lattice openings 17 which can readily guide and shape the water flowing through, on account of the longitudinal extent of the webs forming this lattice structure 14, but oppose this water flow only little. Inserted into the insert housing 2 of the insert units 1, 6, 12 are annular insert parts 28 which have a lattice or mesh structure 15 interposed in the liquid path. The insert parts 28 of the insert units 1, 6, 12 illustrated here have, to this end, a spider-web-like structure of concentric webs which intersect with radial webs at intersection points. The lattice or mesh structures 15 formed in the insert parts 18 favor good mixing of the water flowing through with the ambient air drawn into the housing interior of the insert housing 2.

The water flow carried in the liquid path of the insert units 1, 6, 12 is divided into individual jets in the splitter openings 11, 13 of the jet splitters 9, 10, wherein these individual jets are subjected to an increase in speed which creates a negative pressure on the outflow side of the jet splitters 9, 10. With the aid of this negative pressure, ambient air is drawn into the liquid path. The sanitary insert units 1, 6, 12 have to this end at least one aeration duct which opens into the liquid path beneath the jet splitter 9, 10. This at least one aeration duct is embodied here as a housing opening 18 provided in the housing circumferential wall of the insert housing 2.

In order to limit the amount of water flowing through per unit time to a fixed maximum value, a flow rate regulator 19 is provided in the insert housing 2 on the inflow side upstream of the jet splitter 9, 10, said flow rate regulator 19 regulating the water flowing through to a pressure-independent maximum flow rate. The flow rate regulators 19 used in the insert units 1, 6, 12 have an elastic annular throttle body 20 made of elastic material, which engages around a regulator core 21 and delimits a control gap between itself and regulating profiling 22 provided on the outer circumferential wall of the regulator core or an inner circumferential wall surrounding the throttle body 20, said control gap changing under the pressure of the water flowing through such that the flow rate of the flow rate regulator 20 does not exceed a pressure-independent maximum value.

Figure 13:
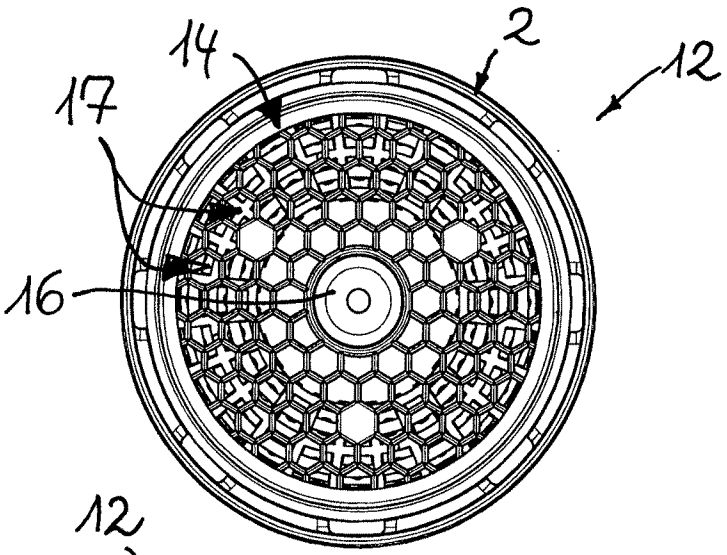
FIG. 13 shows the insert unit from FIG. 12 in a plan view of its outlet end face.
Figure 14:
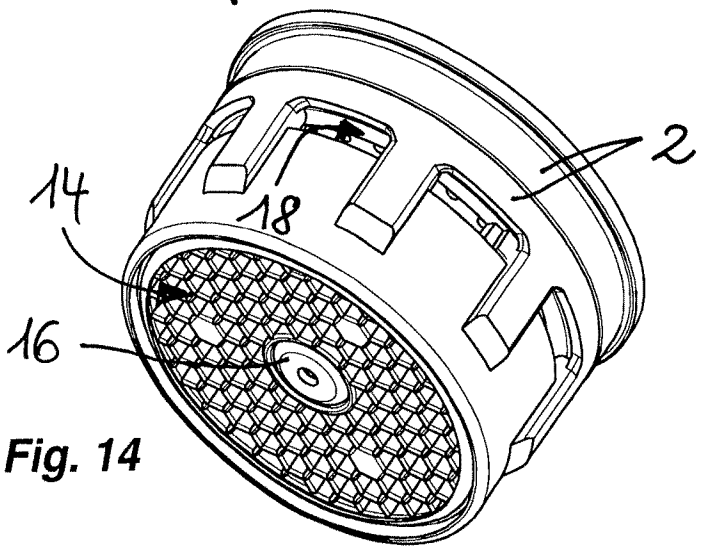
FIG. 14 shows the insert unit from FIGS. 12 and 13 in a perspective side view looking toward the outlet end face of this insert unit.
Figure 12:
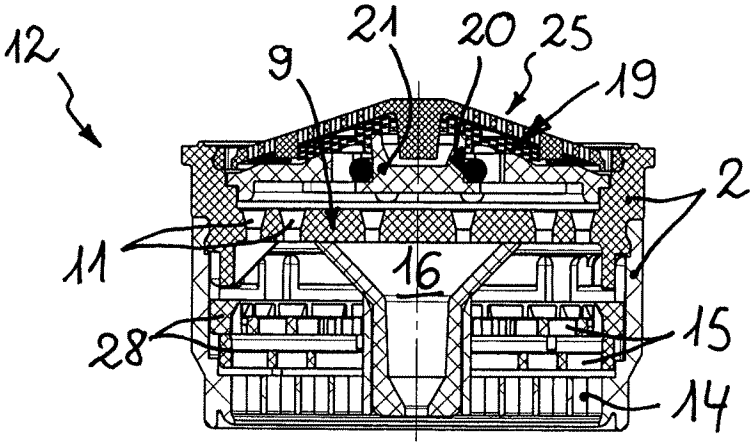
FIG. 12 shows a further exemplary embodiment of a sanitary insert unit which is intended to create a soft, non-spraying overall jet and a central cleaning jet surrounded thereby, in longitudinal section.

In the insert unit 12 shown in FIGS. 12 to 14, the bypass duct 16 has an inflow-side duct opening which is arranged in the liquid path beneath some of the splitter openings 11 and in particular beneath at least two of the splitter openings 11. In order that a hard cleaning jet that cleans effectively can be generated in the bypass duct 16 of the insert unit 12, this bypass duct 16 is dimensioned such that its smallest clear duct cross section comprises a clear cross-sectional area which is smaller than the sum of the clear cross-sectional areas of the splitter openings 11 opening into the inflow-side duct opening.

In the case of the insert units 6, 12 depicted in FIGS. 6 to 11 and 12 to 14, the inflow-side duct opening of the bypass duct 16 is arranged in each case beneath the flow rate regulator 19, such that the maximum value of the flow rate regulated by the flow rate regulator 19 is not exceeded even when the cleaning jet and the amount of water carried by the bypass duct 16 for this purpose are taken into consideration.

In the case of the insert units 1, 6 shown in FIGS. 1 to 5 and 6 to 11, the bypass duct 16 passes through the jet splitter 9 or 10,—in the case of the insert unit 1 according to FIGS. 1 to 5, the bypass duct 16 additionally also passes through the flow rate regulator 19.

While the jet splitter 9 of the insert units 1, 12 shown in FIGS. 1 to 5 and 12 to 14 is in the form of a simple perforated plate, the jet splitter 10 of the insert unit 6 according to FIGS. 6 to 11 is configured as a diffuser which has an impact surface 23 that deflects the inflowing water in the direction of the splitter openings 13, which are provided in an outer circumferential wall of the jet splitter 10 in the form of a diffuser. It is apparent from FIG. 8 that the outer circumferential wall of the jet splitter 10 in the form of a diffuser is surrounded by an annular face 24, and that an annular gap is provided between the outer circumferential wall and this annular face 24, said annular gap narrowing at least partially in the flow-through direction of the water. In accordance with the Bernoulli equation, a negative pressure, with the aid of which ambient air can be drawn in, forms in the housing interior on the outflow side of the annular gap.

In order that dirt particles entrained in the supply network cannot impair the function of the insert units and the constituent parts thereof, the insert units 1, 12 have a filter screen 25 which is arranged in the inflow direction upstream of the jet splitter 9 and optionally also upstream of the flow rate regulator 19 connected in between. While the filter screen 25 of the insert unit 12 shown in FIGS. 12 to 14 widens in an approximately conical manner in the flow-through direction, the filter screen 25 of the insert unit 1 is formed in a funnel-shaped manner, wherein the funnel shape of this filter screen 25 narrows in the direction of an inflow-side duct opening of the at least one bypass duct 16 provided in the insert unit 1.

In order to create a lance-shaped central cleaning jet, the bypass duct 16 of the insert units 1, 12 shown in FIGS. 1 to 5 and 12 to 14 narrows in the direction of a central nozzle opening, said nozzle opening having the smallest clear cross section of the bypass duct in question.

In order, if necessary, to also be able to provide a cleaning jet having a larger jet cross section, the bypass duct 16 narrows in the direction of an annular gap in order to create an annular jet in the insert unit 6 according to FIGS. 6 to 11. The bypass duct 16 of the insert unit 6 has to this end a cylindrical clear cross section, wherein a duct insert element 26 that widens at least partially in a conical manner in the flow-through direction has been inserted into this bypass duct 16, said duct insert element 26 delimiting, between its outer circumference and the inner circumferential wall of the bypass duct 16, the annular gap.

The annular gap or the nozzle opening of the bypass duct 16 provided in the insert units 1, 6, 12 forms an outflow-side duct opening. This outflow-side duct opening is arranged approximately in an outflow-side end plane of the insert housing 2 in the case of the insert units 6, 12. Although the flow rate regulators 19 connected upstream in the insert units 1, 6, 12 can greatly weaken the water jet emerging from the liquid path, a cleaning jet that is comparatively hard is additionally provided in the insert units 1, 6, 12, said cleaning jet nevertheless allowing effective cleaning of soiled hands, toothbrushes, razors or other articles. In this case, a part of the water flowing into the insert units 1, 6, 12 is collected in the at least one bypass duct 16, concentrated there and subsequently passed through a nozzle opening configured as an annular gap or as a hole. In the bypass duct 16 in the form of a nozzle, the concentrated cleaning jet emerging in a comparatively hard manner arises, which is strong enough to be able to clean even a soiled article better. If necessary, the amount of water carried through the bypass duct 16 can also be regulated by the flow rate regulator 19 connected upstream in the insert housing 2. The water flow which is carried by the liquid path and is not collected in the bypass duct 16 formed in a nozzle-like manner first of all passes, as in the case of a conventional jet regulator or jet aerator, through the jet splitter 9, 10 and subsequently through the lattice or mesh structures 14, 15 that are arranged downstream of the jet splitter 9, 10 and serve as a flow straightener or as a homogenizing device. The concentrated, keen cleaning jet arranged centrally in the insert units 1, 6, 12 is circumferentially surrounded by the soft overall jet flowing out of the liquid path, such that the cleaning jet is virtually invisible. The user is given the impression of having a conventional water jet, with which, if required, it is also possible to achieve a sufficient cleaning action, however.

LIST OF REFERENCE SIGNS

1 Sanitary insert unit (according to FIGS. 1 to 5)
2 Insert housing
3 Water outlet
4 Outlet mouthpiece
5 Annular flange
6 Sanitary insert unit (according to FIGS. 6 to 11)
7 Support
8 Thread
9 Jet splitter (in the insert units 1, 12)
10 Jet splitter (in the insert unit 6)
11 Splitter openings (in the jet splitter 9)
12 Sanitary insert unit (according to FIGS. 12 to 14)
13 Splitter openings (in the jet splitter 10)
14 Lattice structure
15 Mesh structure
16 Bypass duct
17 Honeycomb-shaped lattice openings (of the lattice structure 14)
18 Housing opening
19 Flow rate regulator
20 Throttle body made of elastic material
21 Regulator core

22 Regulating profiling
23 Impact surface
24 Annular face
25 Filter screen
26 Duct insert element (of the insert unit 6)
27 Counterpart thread
28 Insert part
29 Sealing ring

The invention claimed is:

1. A sanitary insert unit (1, 6, 12), comprising:

an insert housing (2) which is mountable on or in a water outlet (3) of a sanitary outlet fitting, the insert housing including a housing interior through which a liquid path is provided that is adapted to direct a water flow through the housing interior, a jet splitter (9, 10) located in the liquid path and includes a plurality of splitter openings (11, 13) which are adapted to divide water flowing therethrough into a plurality of individual jets, at least one lattice or mesh structure (14, 15) following the jet splitter (9, 10) in the liquid path, a bypass duct (16) that at least partially bypasses the liquid path, the bypass duct (16) includes a nozzle with a narrowing clear duct cross section which includes a first tapered section that transitions from a widest open clear duct cross-section and a second tapered section downstream of the first tapered section that is adapted to create an accelerated liquid jet that is configured to be separately discharged from an outflow end of the insert housing (2) from the water flow through the at least one lattice or mesh structure such that the accelerated liquid jet has an increased cleaning force in comparison with a contemporaneous flow through the at least one lattice or mesh structure, wherein the bypass duct (16) narrows or tapers in a direction toward an outflow-side duct opening in order to form the nozzle at the second tapered section that has a smallest clear cross-section proximate to an outlet of the bypass duct, and the at least one lattice or mesh structure (14, 15) extends from the first tapered section to the outflow end.

2. The sanitary insert unit (1, 6, 12) as claimed in claim 1, further comprising a flow rate regulator (19) in the insert housing (2) on an inflow side upstream of the jet splitter (9, 10), said flow rate regulator being adapted to regulate the water flowing through to a pressure-independent maximum flow rate.

3. The sanitary insert unit (1, 6, 12) as claimed in claim 2, wherein the flow rate regulator (19) has at least one elastic annular throttle body (20) which engages around a regulator core (21) and delimits a control gap between the at least one elastic annular throttle body and the regulator core (21) or an inner circumferential wall surrounding the throttle body (20), said control gap being adapted to change under pressure of the water flowing through such that a flow rate of the flow rate regulator (19) does not exceed the pressure-independent maximum flow rate.

4. The sanitary insert unit (1, 6, 12) as claimed in claim 2, wherein the flow rate regulator (19) is arranged on the inflow side upstream of the jet splitter (9, 10) or upstream of the jet splitter and an inflow-side duct opening of the bypass duct (16).

5. The sanitary insert unit (1, 12) as claimed in claim 1, wherein the bypass duct (16) narrows or tapers to form at least one conical section.

6. The sanitary insert unit (12) as claimed in claim 1, wherein the bypass duct (16) has an inflow-side duct opening which is arranged in the liquid path beneath at least one of the splitter openings (11).

7. The sanitary insert unit (12) as claimed in claim 6, wherein a smallest clear duct cross section of the bypass duct (16) comprises a clear cross-sectional area which is smaller than a cross-sectional area of the splitter opening (11) that opens into the inflow-side duct opening or is smaller than a sum of clear cross-sectional areas of the splitter openings (11) that open into the inflow-side duct opening.

8. The sanitary insert unit (1, 6) as claimed in claim 1, wherein the bypass duct (16) passes through the jet splitter (9, 10) or the jet splitter and a flow rate regulator (19).

9. The sanitary insert unit (1, 12) as claimed in claim 1, wherein the jet splitter (9) comprises a perforated plate.

10. The sanitary insert unit (1, 12) as claimed in claim 1, further comprising a filter screen (25) arranged in an inflow direction upstream of the jet splitter (9).

11. The sanitary insert unit (1) as claimed in claim 10, wherein an inflow-side duct opening of the bypass duct (16) is arranged in an inflow direction immediately beneath the filter screen (25).

12. The sanitary insert unit (12) as claimed in claim 11, wherein the filter screen (25) widens at least in one section in a flow-through direction.

13. The sanitary insert unit (1) as claimed in claim 10, wherein the filter screen (25) is funnel-shaped, and the funnel shape of the filter screen (25) narrows in a direction of an inflow-side duct opening of the at least one bypass duct (16).

14. The sanitary insert unit (1, 6, 12) as claimed in claim 1, wherein the bypass duct (16) is arranged approximately coaxially with a longitudinal center axis of the insert housing (2).

15. The sanitary insert unit (1, 12) as claimed in claim 1, wherein the bypass duct (16) narrows in a direction of a nozzle opening of the nozzle in order to create a water jet, said nozzle opening having a smallest clear cross section of the bypass duct (16).

16. The sanitary insert unit (1, 6, 12) as claimed in claim 1, wherein the lattice or mesh structure (14) has honeycomb-shaped lattice openings (17) provided on an outflow-side end face of the insert housing (2).

17. The sanitary insert unit (1, 6, 12) as claimed in claim 1, further comprising at least one insert part (28) inserted into the insert housing, said insert part (28) includes the lattice or mesh structure (15) interposed in the liquid path.

18. The sanitary insert unit (1, 6, 12) as claimed in claim 17, wherein the at least one insert part (28) is arranged in the liquid path beneath the jet splitter (9, 10).

19. The sanitary insert unit (1, 6, 12) as claimed in claim 1, further comprising at least one aeration duct which opens into the liquid path beneath the jet splitter (9, 10).

20. The sanitary insert unit (1, 6, 12) as claimed in claim 19, wherein the at least one aeration duct comprises a housing opening (18) provided in a housing circumferential wall of the insert housing (2).

21. A sanitary insert unit (1, 6, 12), comprising:

an insert housing (2) which is mountable on or in a water outlet (3) of a sanitary outlet fitting, the insert housing including a housing interior through which a liquid path is provided that is adapted to direct a water flow through the housing interior, a jet splitter (9, 10) located in the liquid path and includes a plurality of splitter openings (11, 13) which are adapted to divide water flowing therethrough into a plurality of individual jets, at least one lattice or mesh structure (14, 15) following the jet splitter (9, 10) in the liquid path, a bypass duct (16) that partially bypasses the liquid path such that water is adapted to simultaneously flow in the liquid path and the bypass duct (16), the bypass duct (16) comprises a nozzle with a narrowing clear duct cross section which includes a first tapered section that transitions from a widest open clear duct cross-section and a second tapered section downstream of the first tapered section that is adapted to create at least one accelerated liquid jet that is configured to be separately discharged from an outflow end of the insert housing (2) from the water flow through the at least one lattice or mesh structure, wherein the bypass duct (16) narrows or tapers in a direction toward an outflow-side duct opening in order to form the nozzle that has a smallest clear cross-section proximate to an outlet of the bypass duct, and the at least one lattice or mesh structure (14, 15) extends from the first tapered section to the outflow end.

* * * * *